US006931674B1

(12) United States Patent
Dean

(10) Patent No.: US 6,931,674 B1
(45) Date of Patent: Aug. 23, 2005

(54) PORTABLE SHAMPOO APPARATUS

(76) Inventor: Jeannette Dean, 12626 155th Ave. SE., Renton, WA (US) 98059

( * ) Notice: Subject to any disclaimer, the term of this patent is extended or adjusted under 35 U.S.C. 154(b) by 0 days.

(21) Appl. No.: 10/945,288

(22) Filed: Sep. 20, 2004

(51) Int. Cl.[7] ..... A45D 19/08
(52) U.S. Cl. ..... 4/519; 4/515; 4/516; 4/520
(58) Field of Search ..... 4/515–523, 572.1, 4/446, 575.1, 553, 621, 622, 639–641

(56) References Cited

U.S. PATENT DOCUMENTS

| | | | | | |
|---|---|---|---|---|---|
| 45,315 | A | * | 12/1864 | Carr | 4/307 |
| 795,536 | A | * | 7/1905 | Neal | 4/586 |
| 1,658,944 | A | * | 2/1928 | Schaeffer | 4/572.1 |
| 1,791,348 | A | | 2/1931 | Cannady | |
| 2,455,607 | A | | 12/1948 | Price | |
| 2,475,259 | A | | 7/1949 | Singleton | |
| 2,514,584 | A | | 7/1950 | Muth | |
| 2,599,217 | A | * | 6/1952 | Artman | 4/520 |
| 3,046,567 | A | * | 7/1962 | Jackson | 4/621 |
| 3,449,771 | A | | 6/1969 | Watson | |
| 3,579,656 | A | | 5/1971 | Guarrasi | |
| 3,733,620 | A | * | 5/1973 | Glintz | 4/515 |
| 4,266,306 | A | * | 5/1981 | Lee | 4/572.1 |
| 5,092,001 | A | * | 3/1992 | Ross et al. | 4/572.1 |
| 5,528,776 | A | * | 6/1996 | Carmichael | 4/516 |
| 5,926,866 | A | * | 7/1999 | Chao | 4/572.1 |

OTHER PUBLICATIONS

Sally Beauty Supply; Sales catalog: Sally Beauty Supply Quickship Equipment, undated.

* cited by examiner

*Primary Examiner*—Khoa D. Huynh
(74) *Attorney, Agent, or Firm*—David L Tingey

(57) ABSTRACT

A portable shampoo bowl secured to a platform is sized to fit over a traditional kitchen sink with depending lugs extending along sink sides and adjustable on the platform around the platform perimeter to accommodate commonly found sinks to prevent the platform from shifting laterally on the sink. A neck rest channel on the bowl extends forward from the platform and beyond the sink to comfortably reach a person in the neck rest channel. The bottom of the forward portion of the bowl is mildly sloped downward through the forward portion of the bowl to a horizontal bottom portion in which drain holes are located. The bowl is mounted intermediate the length of the platform on its forward portion such that a platform rearward portion remains uncovered as a shelf on which bottles of supplies and tools can be placed, confining drippings from the user's wet hands and general mess from the bottles and such on the platform within the bounds of the sink. A slot in the platform shelf allows the mess to flow through to the sink and also serves as a handle in removing the platform from the sink.

9 Claims, 4 Drawing Sheets

PORTABLE SHAMPOO APPARATUS

BACKGROUND

1. Field of the Invention

This invention relates to portable shampoo bowls, and more specifically to a shampoo rinse bowl adapted for use at a traditional kitchen sink using a platform on which it is secured that is sized to fit over the sink.

2. Prior Art

It is known to have portable shampoo basins. Most are self-contained water reservoirs receiving hair from a person whose head leans over the basin. Some include a drain for emptying the basin. Most include a neck rest to support the head over the basin. Typically, the basin is separate from and independent of an installed household sink for use with bed-ridden persons, for example. For others, the sink offers a convenient source of water and a drain and affords a tub for containing the characteristic water mess encountered in washing hair. However, the sink is otherwise poorly suited for washing hair. For example, the person cannot practically lean her head backwards, that is, face up, over the sink to direct the hair into the sink, which is desirable when another is washing the person's hair. The sink also does not provide a neck rest. Hence, the ease and efficiency of employing the sink as a convenient tub is offset by the impracticality of its use. A portable basin is still required to interface the sink with the person.

It is the object of the present invention to provide a shampoo rinse bowl adapted to be used in combination with a kitchen sink. It is another object to provide a platform that adapts the bowl to a stable fit over the sink. It is a further object that the platform provide a stable shelf over the sink on which shampoo bottles and other hair treatment bottles may be placed. It is yet another object that the bowl and platform mounted over a kitchen sink drain into the sink as water is sprayed onto a person's hair from a kitchen faucet pull-out spray head.

SUMMARY

These objects are achieved in a portable shampoo bowl secured to a platform that is sized to fit over a traditional kitchen sink with depending lugs adjustable on the platform around the platform perimeter to accommodate commonly found sinks. The lugs extend into the sink alongside sink sides preventing the platform from shifting laterally on the sink. Aligned holes in the bowl and platform drain water into the sink that is sprayed from a sink pull out faucet and captured in the bowl. Typically, a plurality of drain holes are employed in the bowl over a large hole in the platform so that hair in the bowl bottom, which is commonly drawn to a single drain hole, does not block water from draining from the bowl.

The bowl includes a neck rest in a forward portion of the bowl, comprising a channel with a rim on the channel perimeter as a yoke around the neck of a person. The rim is supported above the bowl bottom so that a user treating the person's hair can manipulate her hands under the person's head without lifting the head. The person typically sits in front of the sink with her head leaning back onto the neck rest. The yoke portion of the bowl extends forward from the platform and beyond the sink to comfortably reach the person. The bottom of the forward portion of the bowl is mildly sloped downward through the forward portion of the bowl to a horizontal bottom portion in which the drain holes are located. The horizontal bottom sits in face-to-face contact with the platform as a broad and stable base that supports most of the weight on the bowl, distributed across that bottom portion. To support the weight of the person's head on the neck rest, a brace extends from under the bowl forward portion to the platform. Screws in that portion secure the bowl rearward portion to the platform as the brace secures the bowl forward portion to the platform.

The bowl is mounted intermediate the length of the platform on its forward portion such that a platform rearward portion remains uncovered as a shelf on which bottles of shampoo and hair conditioner and other bottles, equipment and tools can be placed. With the bottles and other paraphernalia temporarily placed on the platform shelf, drippings from the user's wet hands and general mess from the bottles and such are contained on the platform within the bounds of the sink and washed down the sink. A slot in the platform shelf allows the mess to flow through to the sink. When the shampoo is completed, the bowl and platform are simply removed by lifting up through the platform slot as a handle, sized to receive a user's fingers.

DETAILED DESCRIPTION OF THE PREFERRED EMBODIMENTS

Figure 1:
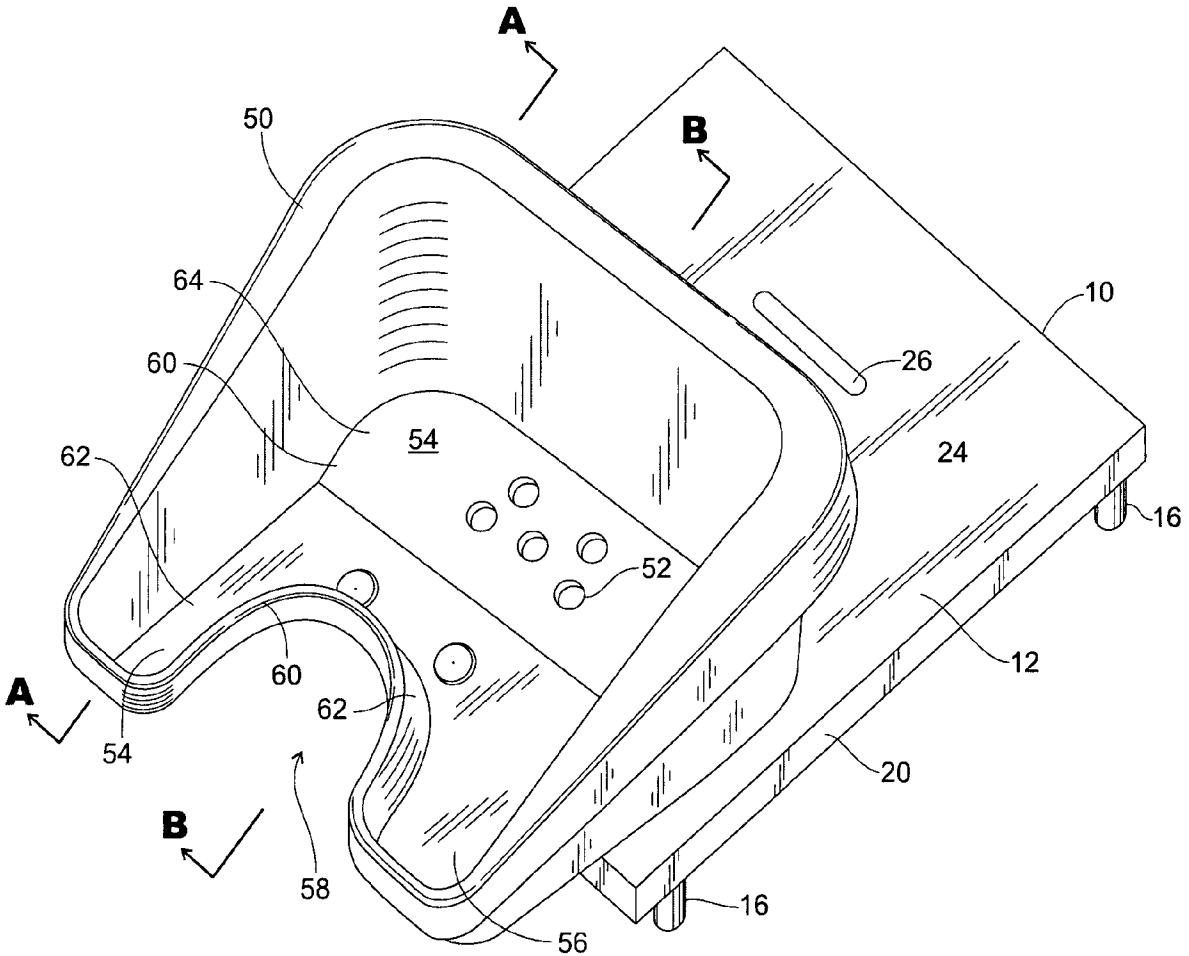
FIG. 1 is a perspective view of the rinsing bowl and platform.
Figure 2:
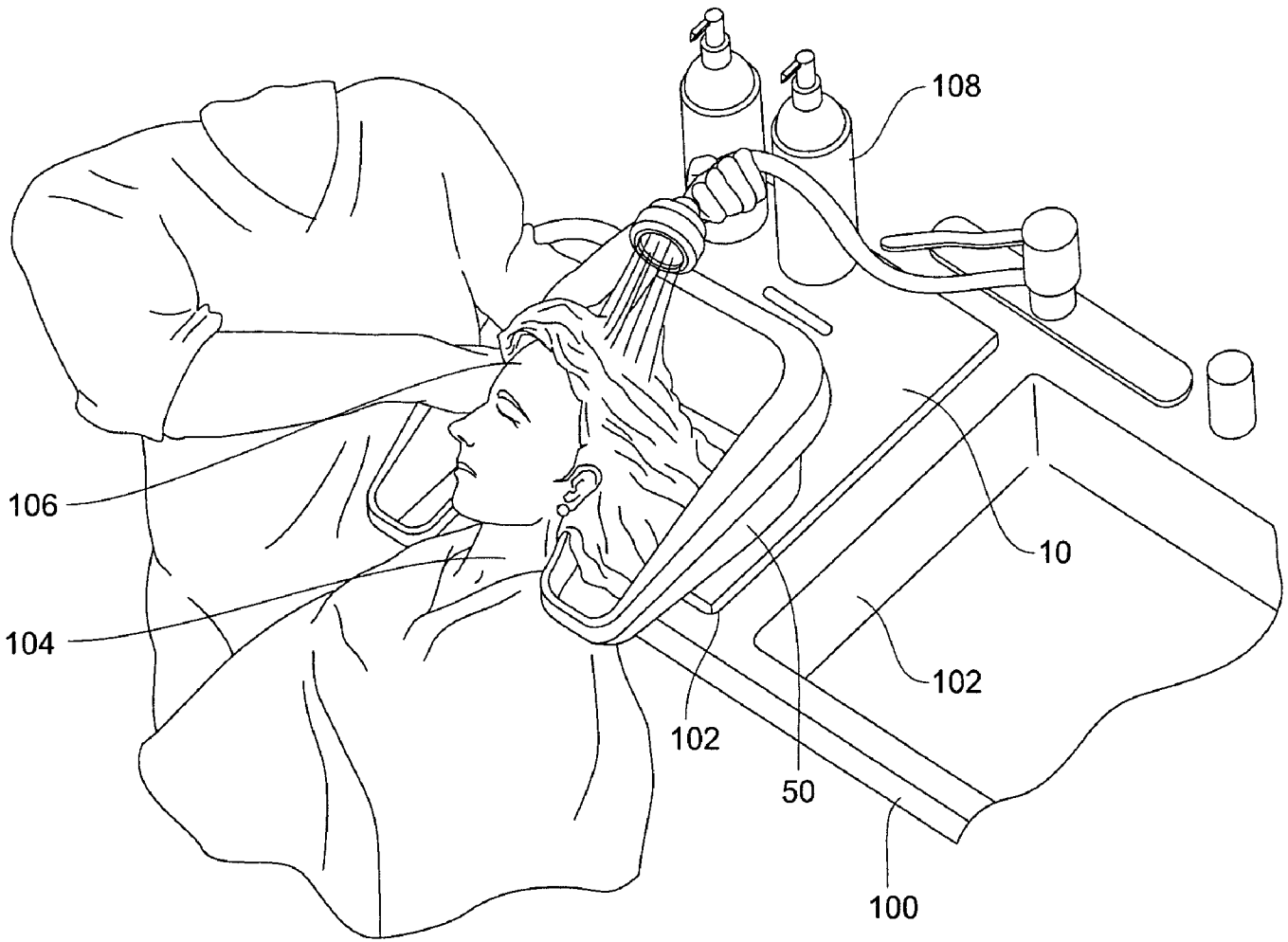
FIG. 2 is a artistic view of the rinsing bowl and platform of FIG. 1 in use with a kitchen sink.
Figure 3:
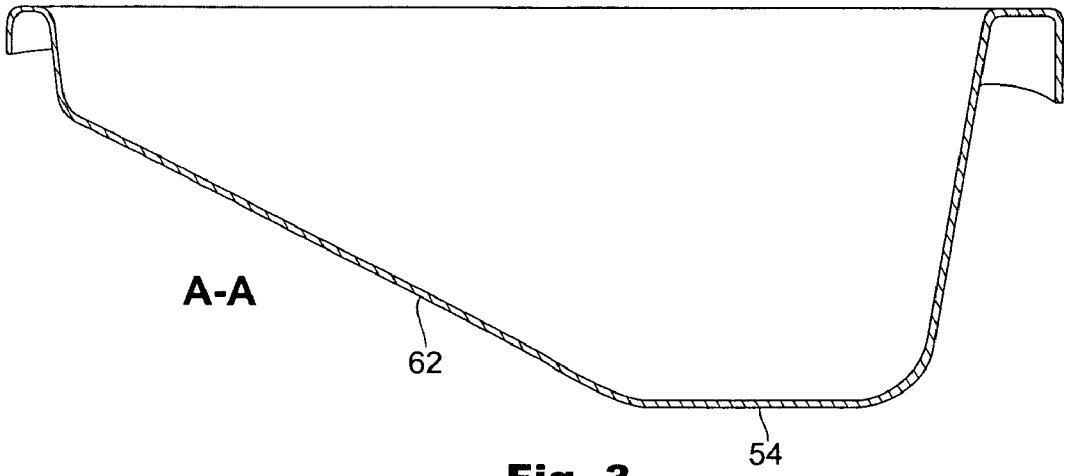
FIG. 3 is a sectional view of the rinsing bowl on the A—A line shown in FIG. 1.
Figure 4:
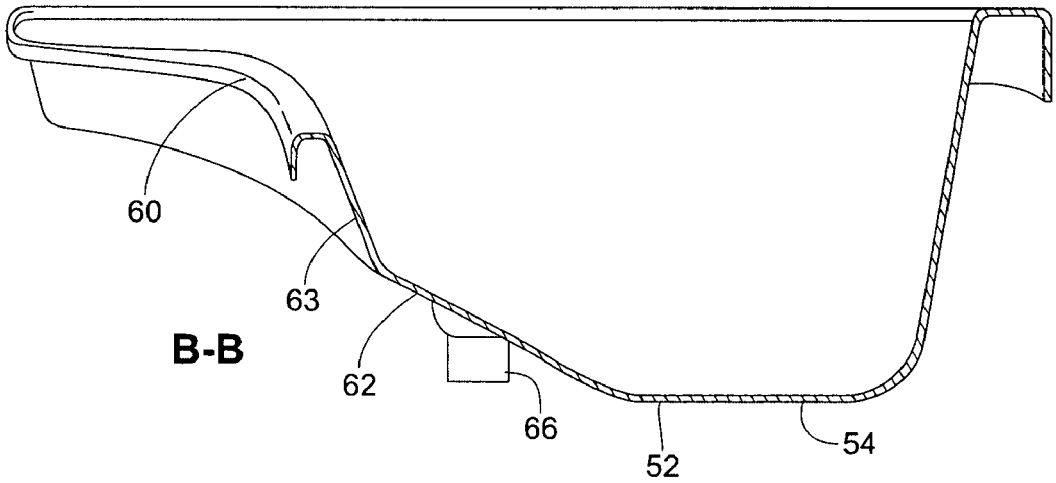
FIG. 4 is a sectional view of the rinsing bowl on the B—B line shown in FIG. 1.
Figure 5:
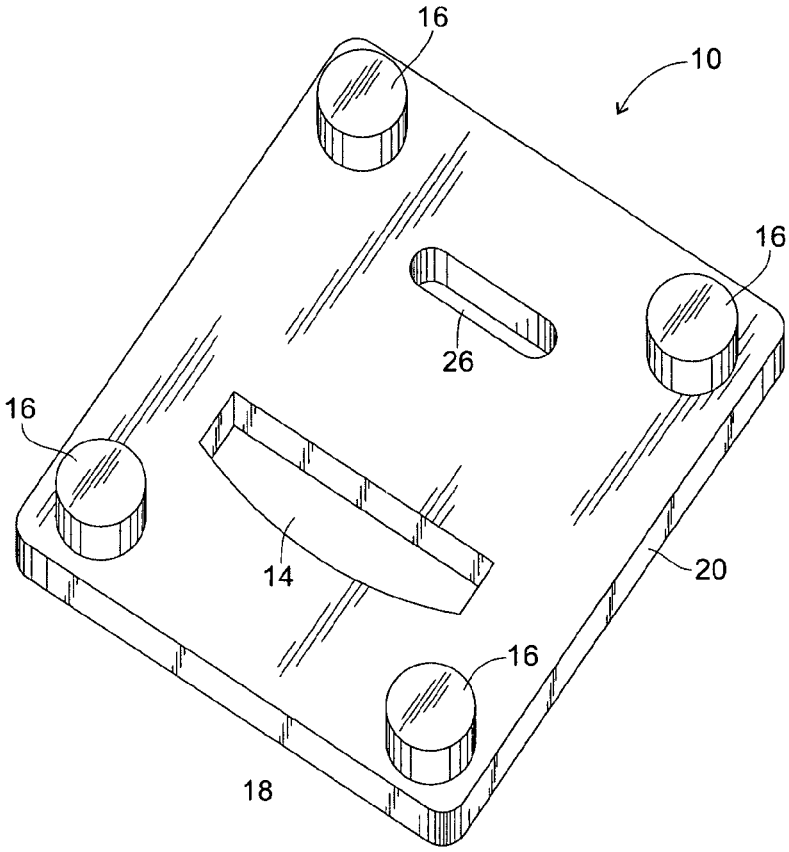
FIG. 5 is a perspective view of the underside of the platform that shows the depending lugs.
Figure 6:
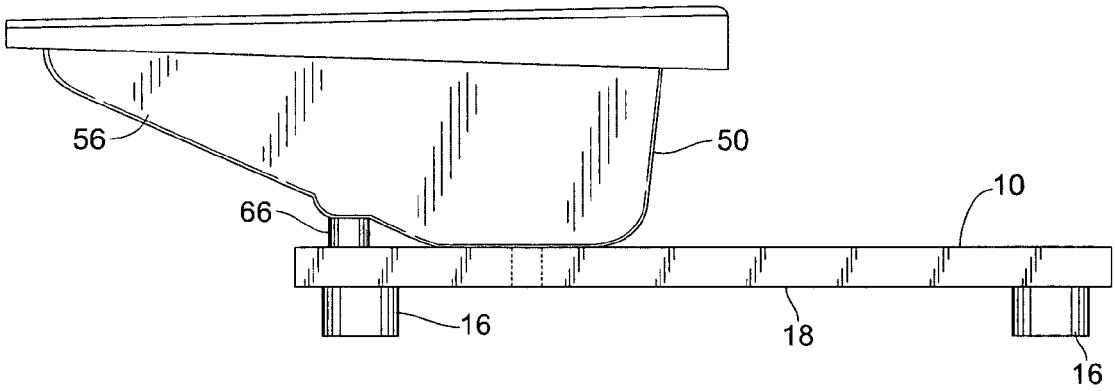
FIG. 6 is a side planar view of the rinsing bowl and platform of FIG. 1.

The portable shampoo apparatus of the present invention comprises a platform 10 sized to fit over sides of a sink 100, removably supporting the platform 10 over the sink 100. The apparatus further comprises a rinse bowl 50 secured to a top 12 of the platform 10 with a bowl drain hole 52 in a bowl bottom 54 aligned with a platform hole 14 in the platform 10 such that water in the rinse bowl 50 drains through the aligned holes into the sink 100.

The platform 10 also includes a plurality of lugs 16 depending downward from a bottom 18 of the platform 10 near platform sides 20, sized to extend into the sink 100 near sink sides 102 when the platform 10 is inserted over the sink 100 such that the platform 10 is held in place on the sink 100.

A forward portion 56 of the rinse bowl 50 extends forward beyond the platform 10 with a channel 58 sized to receive a person's neck 104 such that rinse water sprayed on the person's head 106 falls into the rinse bowl 50. The rinse bowl bottom 60 comprises a sloped portion 62 from the forward portion 56 to a horizontal drain hole portion 52. Preferably, the bowl 50 has a plurality of bowl drain holes 64 all aligned with the platform hole 14. The drain hole portion 64 rests in face-to-face contact with the platform 10. A brace 66 between the bowl bottom sloped portion 62 and the platform 10, supporting the forward portion 56 when the person's head 106 rests on the forward portion 56 at the channel 58.

The rinse bowl 50 is secured intermediate the platform 10, leaving a platform shelf portion 24 over the sink 100 adapted to receive bottles, tools and general treatment supplies and equipment 108 used during shampoo and treatment of a person's hair such that drippings from the supplies 108 drain onto the platform 10 and past the platform 10 into the sink 100. The platform shelf portion 24 includes a slot 26 through which drippings can pass into the sink 100. The slot 26 is sized to receive a user's fingers (not shown) such that the slot 26 also serves as a handle for removing the bowl 50 and platform 10 from the sink 100.

The bowl 50 includes a rim 60 around the channel 58 raised above the bowl bottom 54 on a vertical or steeply sloped channel wall 63 such that the person's head 106, whose neck 104 rests on the rim 60, extends over the bowl 50 above the bowl bottom 54 such that a user treating the person's hair can reach under the person's head 106.

Having described the invention, what is claimed is as follows:

1. A portable shampoo apparatus adapted to be secured over a traditional kitchen sink bowl having a top opening, sides and a closed bottom with a drain, said portable shampoo apparatus comprising a platform configured to fit over sides of a the sink bowl and adapted to cover the top opening, said platform is removably supporting the said portable shampoo apparatus over the sink bowl, said platform further comprises a plurality of lugs extending downward from a bottom of said platform near platform sides, said lugs configured to extend into the sink bowl near sink sides when said platform is inserted over the top opening of the sink bowl such that said platform is held in place on the sink bowl, a rinse bowl secured to a top of the platform with a bowl drain hole in a bowl bottom aligned with a platform hole in the platform such that water in the rinse bowl drains through the aligned holes and into the sink bowl, wherein a forward portion of said rinse bowl extends forward beyond said platform with a channel configured to received a person's neck such that rinse water sprayed on the person's head falls into said rinse bowl.

2. The apparatus of claim 1 wherein the rinse bowl bottom comprises a slope portion from the forward portion to a horizontal drain hole portion.

3. The apparatus of claim 2 wherein the drain hole portion rests in face-to-face contact with the platform.

4. The apparatus of claim 1 further comprising a brace between the bowl bottom sloped portion and the platform, supporting the forward portion when a person's head rests on the forward portion at the channel.

5. The apparatus of claim 1 wherein the rinse bowl is secured intermediate the platform, leaving a platform shelf portion over the sink adapted to receive bottles used during shampoo and treatment of a person's hair such that drippings from the bottles drain onto the platform and past the platform into the sink.

6. The apparatus of claim 5 wherein the platform shelf portion comprises a slot through which drippings can pass into the sink.

7. The apparatus of claim 6 in which the slot is sized to receive a user's fingers such that the slot also serves as a handle for removing the apparatus from the sink.

8. The apparatus of claim 1 wherein the bowl includes a rim around the channel raised above the bowl bottom on a vertical or steeply sloped channel wall such that a person's head, whose neck rests on the rim, extends over the bowl above the bowl bottom such that a user treating the person's hair can reach under the person's head.

9. A portable shampoo apparatus adapted to be secured over a traditional kitchen sink, comprising a platform sized to fit over sides of a sink, removably supporting the platform over the sink, a rinse bowl secured to a top of the platform with a bowl drain hole in a bowl bottom aligned with a platform hole in the platform such that water in the rinse bowl drains through the aligned holes into the sink, a forward portion of the rinse bowl extending forward beyond the platform with a channel sized to receive a person's neck such that rinse water sprayed on the person's head falls into the rinse bowl, the rinse bowl bottom including a slope portion from the forward portion to a horizontal drain hole portion, the drain hole portion resting in face-to-face contact with the platform a plurality of lugs depending downward from a bottom of the platform near platform sides, sized to extend into the sink near sink sides when the platform is inserted over the sink such that the platform is held in place on the sink, a brace between the bowl bottom sloped portion and the platform, supporting the forward portion when a person's head rests on the forward portion at the channel, wherein the rinse bowl is secured intermediate the platform, leaving a platform shelf portion over the sink adapted to receive bottles used during shampoo and treatment of a person's hair such that drippings from the bottles drain onto the platform and past the platform into the sink, and wherein the bowl includes a rim around the channel raised above the bowl bottom on a vertical or steeply sloped channel wall such that a person's head, whose neck rests on the rim, extends over the bowl above the bowl bottom such that a user treating the person's hair can reach under the person's head, and wherein the platform shelf portion comprises a passageway through which drippings can pass into the sink.

* * * * *